United States Patent [19]

Seitzer

[11] 4,021,329

[45] May 3, 1977

[54] PROCESS FOR DISSOLVING SUB-BITUMINOUS COAL

[75] Inventor: Walter H. Seitzer, West Chester, Pa.

[73] Assignee: Suntech, Inc., St. Davids, Pa.

[22] Filed: Jan. 15, 1976

[21] Appl. No.: 649,297

[52] U.S. Cl. ..... 208/10

[51] Int. Cl.[2] ..... C10G 1/08

[58] Field of Search ..... 208/10

[56] References Cited

UNITED STATES PATENTS

| | | | |
|---|---|---|---|
| 3,502,564 | 3/1970 | Hodgson | 208/10 |
| 3,642,607 | 2/1972 | Seitzer | 208/10 |
| 3,687,838 | 8/1972 | Seitzer | 208/10 |
| 3,775,286 | 11/1973 | Mukherjee et al. | 208/10 |
| 3,796,650 | 3/1974 | Urban | 208/10 |
| 3,846,275 | 11/1974 | Urban | 208/10 |
| 3,920,536 | 11/1975 | Seitzer et al. | 208/10 |
| 3,930,984 | 1/1976 | Pitchford | 208/10 |

*Primary Examiner*—Delbert E. Gantz
*Assistant Examiner*—James W. Hellwege
*Attorney, Agent, or Firm*—J. Edward Hess; Donald R. Johnson; Paul Lipsitz

[57] ABSTRACT

A process for dissolving sub-bituminous coal by heating said coal in the presence of a hydrogen donor oil, gaseous carbon monoxide, water, hydrogen, and an iron compound promoted with an alkali or alkali precursor at a temperature of from about 400° to about 425° C and at a total pressure of from about 2000 to about 5000 psig.

6 Claims, No Drawings

PROCESS FOR DISSOLVING SUB-BITUMINOUS COAL

Numerous coal liquefaction processes are well known in the art. For example, U.S. Pat. No. 2,686,152 discloses a lignitic coal extraction process carried out with an organic solvent such as Tetralin or a mixture thereof with a phenol at temperatures between about 480° F (249° C) and about 900° F (460° C) with or without hydrogen being used, and at atmospheric or at autogenous hydrogen pressure. This prior art disclosure indicates that liquid products are formed in an amount ranging from about 7% to about 50%. Such a procedure cannot economically lend itself toward commercial production of liquid products, since what is needed in any commercial coal liquefaction process is essentially complete liquefaction of the coal.

It is also known as reported in Table 18 in chapter 22 of "Chemistry of Coal Utilization" edited by H. H. Lowry (John Wiley and Sons, 1963) that bituminous coal may be liquified by hydrogenating its slurry at 460° C in a pasting oil using various catalysts such as nickel, molybdenum, iron, and tin. Although the degree of solubilization reported is quite high, such processes have the severe disadvantage of requiring large volumes of expensive hydrogen and require temperatures above 450° C for significant solubilization to occur.

Recently, as disclosed in U.S. Pat. No. 3,594,304 (Seitzer and Shinn, assigned to Sun Oil Co., issued July 20, 1971) a coal liquefaction process for sub-bituminous coal has been found which is able to achieve solution of 90% or more of the coal. This is accomplished by subjecting a sub-bituminous coal to solution in a hydrogen donor solvent under pressure of hydrogen of from about 2000 to about 3000 psig and maintaining the temperature of the process within the narrow range 440° to 450° C for a period of about 5 to about 20 minutes residence time. This process is a significant improvement over previously available processes, but it does have an economic liability in that it requires the pressure of hydrogen used in the system to be rather high (2000 to 3000 psig) in order to achieve high dissolution of coal.

It is also known to convert sub-bituminous coal to benzene-soluble and volatile materials by use of a carbon monoxide and water atmosphere, but relatively low conversions are obtained by this technique. Thus, Appell and Wender (Reprints, Am. Chem. Soc., Div. of Fuel Chem., 156 Nat. Meeting, Sept. 1968; v. 12, No. 3, pp. 220–224) report that at 375° C and short contact times, a conversion of 43% of sub-bituminous coal to benzene-soluble and volatile materials was obtained with carbon monoxide and water at a pressure of 4200 psig. With hydrogen at 5700 psig, the conversion was 27%. At 425° C the difference in conversion decreased, but still favored the carbon monixide-water by a significant margin.

In U.S. Pat. No. 3,819,506 there is disclosed that a high degree of sub-bituminous coal dissolution can be achieved without the previously required high hydrogen pressures, and even at somewhat lower temperatures than that of U.S. Pat. No. 3,594,304 referred to above, if the process is carried out in a gaseous atmosphere of hydrogen (at relatively low pressure), carbon monoxide and water by employing a hydrogenated anthracene oil. The process of that invention comprises dissolving sub-bituminous coal by heating a slurry of said coal in a solvent of anthracene oil especially hydrogenated to contain from about 7% to about 9% hydrogen, in the presence of carbon monoxide, hydrogen, and water, at about 400° to about 425° C and at a total pressure of from about 2000 to about 5000 psig. Although that process represents a significant improvement in the art in that a lower hydrogen pressure is required, any coal dissolution plant using the process still requires both a hydrogen plant and a solvent hydrogenator and such capital investment will add to overall cost.

In Specification B-32-3568 published Jan. 28, 1975 under the Trial Voluntary Protest Program (now U.S. Pat. No. 3,920,536) it is disclosed that sub-bituminous coal may readily be essentially completely solubilized by an economical highly efficient process using a solvent which need not be especially hydrogenated. This is accomplished by hydrogenating sub-bituminous coal in the presence of a donor solvent oil, carbon monoxide, water, and an alkali metal or ammonium molybdate at an elevated temperature of about 400° to about 425° C and at a total pressure of about 2000 to about 5000 psig. It appears that the molybdate present acts as a catalyst to effect liquefaction without use of the especially hydrogenated solvent. Furthermore, the pressure of hydrogen is relatively low since the total pressure in the system is the sum of the pressures of steam, carbon monixide, and hydrogen, which will be about equal at operating temperature. In this way the coal is essentially completely solubilized at relatively low hydrogen pressure and the liquid which is obtained is readily handled and subjected to normal refinery operations to provide useful liquid fuels.

In Specification B-32-3568 it is also pointed out and exemplified that other metal salts, even though some are known to promote solubility in coal hydrogenation, were not operable in the process under relatively low hydrogen pressure. Now, however, it has been found that if a strong alkali, such as an alkali metal hydroxide or its precursor is employed as a promoter for iron oxide or its precursor such a system will effectively catalyze the dissolution of sub-bituminous coal by heating it in the presence of a hydrogen donor oil, gaseous carbon monoxide, water and hydrogen at a temperature of from about 400° to about 425° C and at a total pressure of from about 2000 to about 5000 psig.

As indicated, the coal used in the process of the invention will be a sub-bituminous coal and this will include lignite coals such as North Dakota lignite, Wyodak, Big Horn, Powder River Sub-Bituminous Coal, and the like.

The oil used in the process of the invention is a hydrogen donor solvent. These donor solvent materials are well known and comprise aromatic hydrocarbons which are partially hydrogenated, generally having one or more of the nuclei at least partially saturated. Several examples of such materials are tetralin, dihydronaphthalene, dihydroalkylnaphthalenes, dihydrophenanthrene, dihydroanthracene, dihydrochrysenes, tetrahydrochrysenes, tetrahydropyrenes, tetrahydrofluoranthenes and the like. Of particular value in the process of this invention as hydrogen donor solvents are the hydrophenanthrenes and hydroanthracenes such as dihydroanthracene. It will be understood that these materials may be obtained from any source, but are readily available from coal processing systems as anthracene oil, and the like. Of particular value are recycle oils from the coal dissolving process of the invention.

The iron compounds to be used in the process will be ferrous and ferric salts or oxides. Oxides such as $Fe_2O_3$ and $Fe_3O_4$ are typically useful. Iron salts such as the halides (e.g., chlorides, bromides, etc.) carbonates, oxalates, acetates, sulfates, nitrates and the like are useful precurors since under the alkaline conditions they will be converted to oxides. The amount of iron oxide or salts used in the process may vary over a wide range, but the usual amount will be from about 0.5 to about 10% by weight of the coal used, preferably from about 1 to about 7%.

As indicated, the process requires the presence of an alkali hydroxide or its precursor. It is disclosed in the art that alkalis may be used in conjunction with other catalysts in coal liquifaction processes. For example, a disclosure in "Chemistry of Coal Utilization", Supplementary volume, H. H. Lowry, Editor, John Wiley & Sons, 1963, page 1050 indicates that a char (from Winkler gasifier using brown coal) was hydrogenated by impregnating with 5% $FeSO_4$ and then with an equivalent amount of caustic, the catalyst being ground in an asphaltene-free heavy oil. The Fe-containing liquid-phase catalyst was said to satisfactorily replace molybdenum. However, in the sub-bituminous coal liquifaction operation where coal is heated in the presence of a hydrogen donor oil, gaseous carbon monoxide, water and hydrogen, neither alkali alone, nor the presence of iron alone is effective in achieving coal solubilization. Thus, it is unexpected that these two ineffective agents, when used together enable significant liquifaction of sub-bituminous coal to be achieved.

The alkali hydroxides which appear to promote solution of the coal will preferably be an alkali metal hydroxide, ammonium hydroxide, or any precursor of these materials. By precursor is meant a material which under conditions of the process will be converted to an alkali and thereby serve to function in the manner of an alkali metal or ammonium hydroxide. Examples of such materials are alkali metal and ammonium salts of carbonates, acetates, nitrates oxalates, halides (e.g., chlorides, bromides, and iodides) and the like, which under the reaction conditions are hydrolyzed to alkali metal or ammonium hydroxides. The amount of alkali hydroxide used will be from about 0.5 to about 10% by weight of the coal, preferably from about 1 to about 7%.

In one technique for carrying out the process of the invention a slurry of powdered sub-bituminous coal in the solvent is introduced into a pressure reactor. An amount of coal and solvent will generally be used such that the weight ratio of solvent to coal will be from about 1:1 to 5:1, preferably about 2:1. Although a higher ratio may be used, it may be uneconomical to do so. Then, if the water, carbon monoxide, and hydrogen are added as separate entities, water is placed in the reactor, and after closing it, it is pressured with carbon monoxide and with hydrogen. In the process of the invention, both the hydrogen and the carbon monoxide make a contribution to the coal dissolution efficiency. Preferably, the partial pressure of hydrogen will be about the same as the carbon monoxide partial pressure. Likewise, the steam pressure generated from the water will preferably be equivalent to the hydrogen or carbon monoxide partial pressure. As the contents of the reactor are stirred or agitated, the temperature is raised rapidly to the temperature range of about 400° to about 425° C and the total pressure rises to between about 2000 to about 5000 psig. The residence time for solution of the coal to occur is not critical and will usually be from about 0.5 to about 2 hours, preferably about 1 hour, during which time over about 80% by weight of the coal will be brought into solution.

It is to be understood that the particle size of the coal used is not a critical parameter of the process. While it is preferred to use coal which has been comminuted, coarse particles and very large pieces will also be affected by the process and brought into solution. In fact, the process may even be carried out in subterranean coal mines, the seams of coal being solubilized by feeding the solvent with suspended molybdate promoter, carbon monoxide and steam into a closed underground cavern to build up heat and pressure as required by the process. The solubilized coal is then pumped from the cavern for use as later described.

In a preferred technique, the source of carbon monoxide, water, and hydrogen will be producer gas which is readily available from various sources in refinery operations. Producer gas is made by blowing a mixture of air or oxygen and steam through a bed of incandescent carbonaceous fuel and its composition will vary depending upon the source of fuel and equipment used in making the gas (see Cost Engineering, July 1963, pages 4–11). Typically, producer gas from coke made with oxygen contains on a percent by volume basis about 53% CO and about 31% hydrogen and such a gas is quite useful. A producer gas from oxygen and subbituminous coal, on the other hand, will contain about equal amounts of CO and $H_2$. It will be understood that the composition of the producer gas used may be adjusted so as to provide the desired partial pressures of hydrogen and carbon monoxide in the pressure reactor used in subject invention, but with a gas such as described above, no such adjustment is necessary. Since producer gas may or may not contain water vapor, it may be adjusted to contain this component also, preferably in an amount such that the water:CO molar ratio is from about 2:1 to 1:2, but, of course, water may be introduced into the reactor separately. The major advantage in using producer gas is that it provides an economical source of reactant carbon monoxide and hydrogen, and, furthermore, does not need to be refined for use in the process as the other components ($CO_2$, $H_2S$, $NH_3$, $CH_4$ and $M_2$) do not interfere. Since the process of the invention is uniquely suited to use of producer gas, it is particularly valuable in providing an economical coal dissolving process.

The dissolved coal formed by the process of the invention is a valuable product similar in many respects to a crude oil and is subjected to the usual refining operations to produce petroleum products. For use in this manner, the solution is merely filtered to remove the small amount of insoluble products present, and the filtrate treated in accord with conventional refinery techniques. The product coal solution is also useful for recycle in the process of the invention and acts as the hydrogen donor oil.

In order to more fully describe the invention, the following examples are given:

EXAMPLE 1

A 1-liter stirred autoclave is charged with 33 g of powdered Wyodak coal (20 mesh) and 67 g of anthracene oil and then 15 g of water containing the catalyst. The reactor is sealed, pressure tested and then pressured with 600 psig of hydrogen and 600 psig of carbon monoxide. The reactor is heated to 415° C for 1 hour. The reactor is then allowed to cool, and the product filtered to remove the solids which are washed with a toluene-acetone mixture, dried, and weighed. The data are shown in the following Table.

TABLE I

DISSOLUTION OF WYODAK COAL STIRRED REACTOR 33 grams coal, 67 grams anthracene oil, 600 psig. CO;600 psig. $H_2$; 15 grams $H_2O$, 415° C. for 1 hr.

| Example No. | Catalyst | Gms. | Final Psig. | % MAF* Coal Dissolved |
|---|---|---|---|---|
| 1 | $Fe_2O_3$ | 2 | 3700 | 66 |
| 2 | $FeSO_4$ | 2 | 3500 | 49 |
| 3 | $FeCl_2 . 4H_2O$ | 2 | 3700 | 66 |
| 4 | $Fe_3O_4$ | 2 | 3700 | 60 |
| 5 | NaOH | 2 | 3500 | 66 |
| 6 | $Fe_2O_3$ | 2 | 3200 | 80 |
| | NaOH | 2 | | |
| 7 | $Fe_2O_3$ | 2 | 3300 | 78 |
| | NaCl | 2 | | |

*MAF = Moisture and Ash Free

As can be seen from the above data, only the combination of iron and alkali (Examples 6 and 7) gives a high yield of coal dissolution. Iron alone (Examples 1–4) and alkali alone (Example 5) give significantly lower yields of solubilized coal product.

The invention claimed is:

1. A process for dissolving sub-bituminous coal comprising heating said coal in the presence of a hydrogen donor oil, gaseous carbon monoxide, water, hydrogen, and an iron compound promoted with an alkali or alkali precursor at a temperature of from about 400° to about 425° C and at a total pressure of from about 2000 to about 5000 psig.

2. The process of claim 1 where the alkali is an alkali-metal hydroxide.

3. The process of claim 2 where the alkali-metal hydroxide is sodium hydroxide.

4. The process of claim 1 where the alkali precursor is sodium chloride.

5. The process of claim 1 where the source of carbon monoxide, water and hydrogen is producer gas.

6. The process of claim 1 where the hydrogen donor oil is recycled dissolved coal product.

* * * * *